US006478312B1

(12) United States Patent
Petrucci et al.

(10) Patent No.: US 6,478,312 B1
(45) Date of Patent: Nov. 12, 2002

(54) BRAKE SYSTEM FOR A WHEELED ARTICLE

(75) Inventors: Gary M. Petrucci, 2974 County Rd. 24, Medina, MN (US) 55340; Louis F. Polk, III, Excelsior, MN (US); George D. Stickler, Shorewood, MN (US)

(73) Assignee: Gary M. Petrucci, Medina, MN (US)

( * ) Notice: Subject to any disclaimer, the term of this patent is extended or adjusted under 35 U.S.C. 154(b) by 0 days.

(21) Appl. No.: 09/769,056

(22) Filed: Jan. 24, 2001

Related U.S. Application Data

(60) Provisional application No. 60/213,645, filed on Jun. 23, 2000.

(51) Int. Cl.[7] ..... A63C 17/14

(52) U.S. Cl. ..... 280/11.211; 280/11.212; 280/11.213; 280/11.215; 188/29

(58) Field of Search ..... 188/29; 280/11.211, 280/11.212, 11.213, 11.214, 11.215

(56) References Cited

U.S. PATENT DOCUMENTS

| | | | |
|---|---|---|---|
| 1,801,205 | A | 4/1931 | Mirick |
| 2,535,763 | A | 12/1950 | Tucker |
| 2,616,525 | A | 11/1952 | Du Bois |
| 3,330,207 | A | 7/1967 | De Man |
| 3,858,692 | A | 1/1975 | Luchier et al. |
| 4,108,451 | A | 8/1978 | Scheck, Sr. |
| 4,273,345 | A | 6/1981 | Ben-Dor et al. |
| 4,300,781 | A | 11/1981 | Riggs |
| 4,699,390 | A | 10/1987 | Cote |
| 4,805,936 | A | 2/1989 | Krantz |
| 4,909,523 | A | 3/1990 | Olson |
| 4,943,075 | A | 7/1990 | Gates |
| 5,028,058 | A | 7/1991 | Olson |
| 5,029,882 | A | 7/1991 | Marandel |
| 5,052,701 | A | 10/1991 | Olson |
| 5,067,736 | A | 11/1991 | Olson et al. |
| 5,088,748 | A | 2/1992 | Koselka et al. |
| 5,106,110 | A | 4/1992 | Williamson |
| 5,135,244 | A | 8/1992 | Allison |
| 5,143,387 | A | 9/1992 | Colla |
| 5,171,032 | A | 12/1992 | Dettmer |
| 5,183,275 | A | 2/1993 | Hoskin |
| 5,192,099 | A | 3/1993 | Riutta |
| 5,197,572 | A | 3/1993 | Roberts |
| 5,207,438 | A | 5/1993 | Landers |
| 5,211,409 | A | 5/1993 | Mitchell et al. |
| 5,226,673 | A | 7/1993 | Cech |
| 5,232,231 | A | 8/1993 | Carlsmith |
| 5,236,058 | A | 8/1993 | Yamet et al. |
| 5,239,941 | A | 8/1993 | Chibi |
| 5,251,934 | A | 10/1993 | Gates |
| 5,253,882 | A | 10/1993 | Mitchell |
| 5,253,883 | A | 10/1993 | Moldenhauer |
| 5,257,795 | A | 11/1993 | Babcock |
| 5,275,259 | A | 1/1994 | Roberts |
| 5,280,930 | A | 1/1994 | Smathers et al. |
| 5,280,931 | A | 1/1994 | Horton |
| 5,286,043 | A | 2/1994 | Tkaczyk |
| 5,299,815 | A | 4/1994 | Brosnan et al. |

(List continued on next page.)

FOREIGN PATENT DOCUMENTS

| | | |
|---|---|---|
| CH | 219682 | 2/1942 |
| EP | 0 585 764 A1 | 3/1994 |
| EP | 0 600 274 A1 | 6/1994 |
| EP | 0 607 817 A2 | 7/1994 |
| EP | 0 608 740 A2 | 8/1994 |

*Primary Examiner*—Brian L. Johnson
*Assistant Examiner*—J. Allen Shriver
(74) *Attorney, Agent, or Firm*—Dorsey & Whitney LLP

(57) ABSTRACT

An inline skate and brake system including a plurality of skate wheels with a first braking surface and a plurality of brake members with a second brake surface and an actuation mechanism for causing movement of the brake element brake surfaces into and out of braking engagement with the brake surfaces of the wheels.

21 Claims, 7 Drawing Sheets

U.S. PATENT DOCUMENTS 5,308,093 A 5/1994 Walin
5,312,120 A 5/1994 Wiegner
5,316,325 A 5/1994 Mitchell et al.
5,320,367 A 6/1994 Landis
5,330,207 A 7/1994 Mitchell
5,335,924 A 8/1994 Richards, Sr. et al.
5,340,131 A 8/1994 Smathers et al.
5,342,071 A 8/1994 Soo
5,348,320 A 9/1994 Gay
5,349,238 A 9/1994 Ohsawa et al.
5,351,974 A 10/1994 Cech
5,374,070 A 12/1994 Pellegrini, Jr. et al.
5,374,071 A 12/1994 Johnson
5,375,859 A 12/1994 Peck et al.
5,388,844 A 2/1995 Pellegrini, Jr. et al.
5,397,137 A 3/1995 Pellegrini, Jr. et al.
5,397,138 A 3/1995 Mangelsdorf
5,398,949 A 3/1995 Tarng
5,398,950 A 3/1995 Tkaczyk
5,401,038 A 3/1995 Peck et al.
5,403,021 A 4/1995 Shifrin
5,411,276 A 5/1995 Moldenhauer
5,413,362 A 5/1995 De Santis
5,415,419 A 5/1995 Bourque
5,435,579 A 7/1995 Pozzobon
5,435,580 A 7/1995 Balbinot et al.
5,437,466 A 8/1995 Meibock et al.
5,439,238 A 8/1995 Neal
5,462,296 A 10/1995 Pozzobon
5,462,297 A 10/1995 Lee
5,464,235 A 11/1995 Goldman et al.
5,465,984 A 11/1995 Pellegrini, Jr. et al.
5,468,004 A 11/1995 Olson et al.
5,470,085 A 11/1995 Meibock et al.
5,472,218 A 12/1995 Pratt
5,478,094 A 12/1995 Pennestri
5,482,301 A 1/1996 Babcock
5,486,011 A 1/1996 Nelson
5,486,012 A 1/1996 Olivieri
5,487,552 A 1/1996 Daoust
5,564,718 A 10/1996 Mitchell et al.
5,584,491 A * 12/1996 Kronyak, Jr. ..... 280/11.212
5,803,468 A 9/1998 Petrucci et al.
5,868,404 A * 2/1999 Montague ..... 280/11.213
6,254,109 B1 * 7/2001 Horton ..... 280/11.214

* cited by examiner

BRAKE SYSTEM FOR A WHEELED ARTICLE

This application claims the benefit of Provisional Application No. 60/213,645 filed Jun. 23, 2000.

BACKGROUND OF THE INVENTION

1. Field of the Invention

The present invention relates generally to a brake system for a wheeled article and more specifically to a brake system or personal wheeled article such as an inline skate or the like. The brake system of the present invention has particular applicability to being mechanically or electronically actuated and/or remotely controlled.

2. Description of the Prior Art

A variety of braking methods and systems have been developed for inline skates. Hand operated brakes such as those exemplified by U.S. Pat. No. 5,349,238, U.S. Pat. No. 5,411,276 and U.S. Pat. No. 3,330,207 utilize a cable between a hand-held brake and actuator and a brake device mounted to one or both of the skates. Other hand operated brakes such as those exemplified by U.S. Pat. No. 5,280,930 and U.S. Pat. No. 5,340,131 utilize a hydraulic conduit or line extending from a hand actuator to a brake on the skate. Although hand operated brakes function satisfactorily, they are not widely used.

Foot mounted brakes typically rely on one or more of several techniques for applying the brake force. One system involves use of various types of skid pads located at the toe or heel of the skate which are simply dragged on the skating surface. A second system involves utilizing an auxiliary wheel or roller which makes contact with a brake pad or a braking surface. A third technique involves forcing a braking surface against one or more of the load bearing wheels.

Various brake systems also exist which exert spring or hydraulic force against the wheels. Examples include those shown in U.S. Pat. No. 5,803,468, U.S. Pat. No. 5,411,276 and U.S. Pat. No. 5,351,974.

Although a wide variety of inline brake systems and techniques currently exist for personal wheeled articles such as inline skates, there is a continuing need for an improved brake system. Further, there is a need for an improved brake system with improved control, which can brake one or more wheels of an inline brake simultaneously and which has particular applicability to being mechanically or electronically actuated and/or remotely controlled.

SUMMARY OF THE INVENTION

The present invention relates to an improved brake system for a personal wheeled article and in particular a skate product such as an inline skate. More particularly, the present invention relates to an improved brake system which is capable of simultaneously braking one or more wheels of such article or inline skate and which has particular applicability to being mechanically or electronically actuated and/or remotely controlled.

More specifically, the brake system of the present invention is designed for use with an inline skate and includes a wheel support frame and one or more brake elements carried by the wheel support frame. Each brake element has a brake surface and is moveable relative to the frame between a brake position in which such brake surface engages a portion of the inline skate wheel and a non-brake position in which such brake surface is disengaged from the inline skate wheel. The brake element is caused to move between its brake and non-brake positions by an actuation member or bar in response to corresponding movement of an actuator.

In the preferred embodiment, the brake elements comprise a pair of pivotable callipers which are associated with each of the wheels of an inline skate. The callipers are twin callipers which include arm portions with brake pads defining a brake surface near their distal ends for engaging a brake surface on the wheel. An opposite end of the callipers includes a cam follower for engagement with a cam surface in the actuator member. The actuator member is in the form of an elongated actuator bar and is common to each of the callipers. Thus, movement of the actuator bar results in corresponding braking or non-braking movement of the callipers, in unison. In the preferred embodiment, the movement of the actuator bar and thus the callipers is driven by an electric, battery-driven solenoid which is in turn remotely controlled by the user.

The brake system of the present invention also preferably uses a single twin calliper to brake more than one wheel. This reduces the weight and complexity of the brake system, while at the same time providing improved braking force.

Accordingly, it is an object of the present invention to provide an improved brake system for a personal wheeled article.

Another object of the present invention is to provide a brake system for an inline skate.

Another object of the present invention is to provide an inline skate braking system for individually braking multiple wheels of the inline skate.

A further object of the present invention is to provide a brake system for an inline skate which is particularly applicable to being remotely controlled.

A still further object of the present invention is to provide a brake system for an inline skate embodying an improved structure for simultaneously braking two or more wheels of the skate. These and other objects of the present invention will become apparent with reference to the drawings, the description of the preferred embodiment and the appended claims.

DESCRIPTION OF THE PREFERRED EMBODIMENT

The present invention relates generally to a brake system for a personal wheeled article. Although it is contemplated that the brake system of the present invention can be used with a variety of personal wheeled articles such as motorized or non-motorized skate boards, scooters, carts, skates or any multi-wheeled article, it has particular applicability to skates and still more particular applicability to inline skates. Accordingly, the preferred embodiment will be described with respect to an inline skate and more particularly to a brake for braking one or more wheels of an inline skate. Although the brake of the present invention can be used with either a remote control, or a tethered control, or neither, it has particular applicability to a remote control system of the type disclosed, for example only, in U.S. Pat. No. 5,803,468. The substance of Pat. No. 5,803,468 is incorporated herein by reference. Further, as will be described below, the preferred embodiment is provided with an electrically actuated brake in which the brake force is mechanically applied. It is contemplated, however, that the brake systems of the present invention may be hydraulically or pneumatically actuated and/or applied as well.

Figure 1:
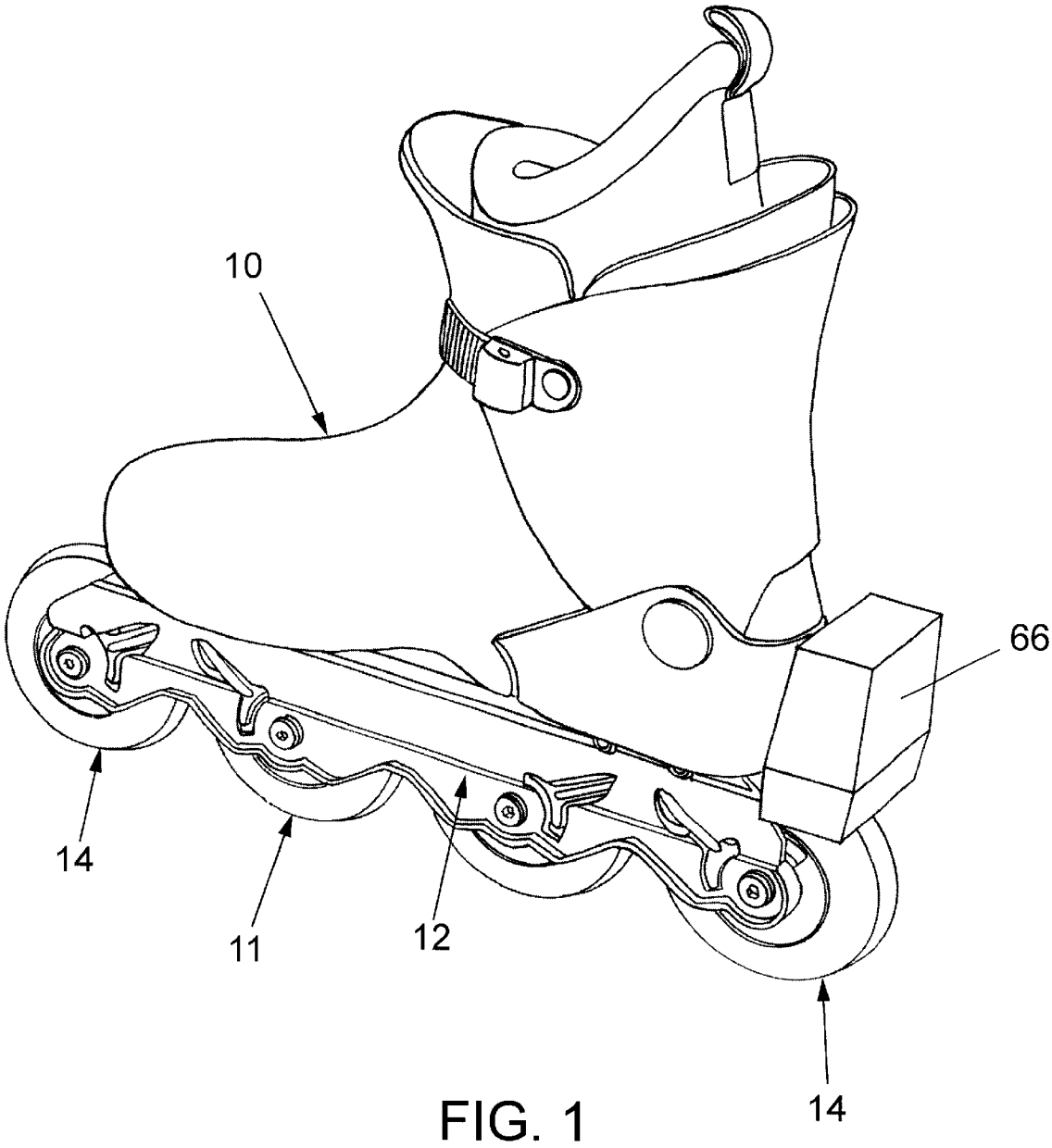
FIG. 1 is an isometric view of an inline skate with the skate brake system of the present invention attached thereto.
Figure 2:
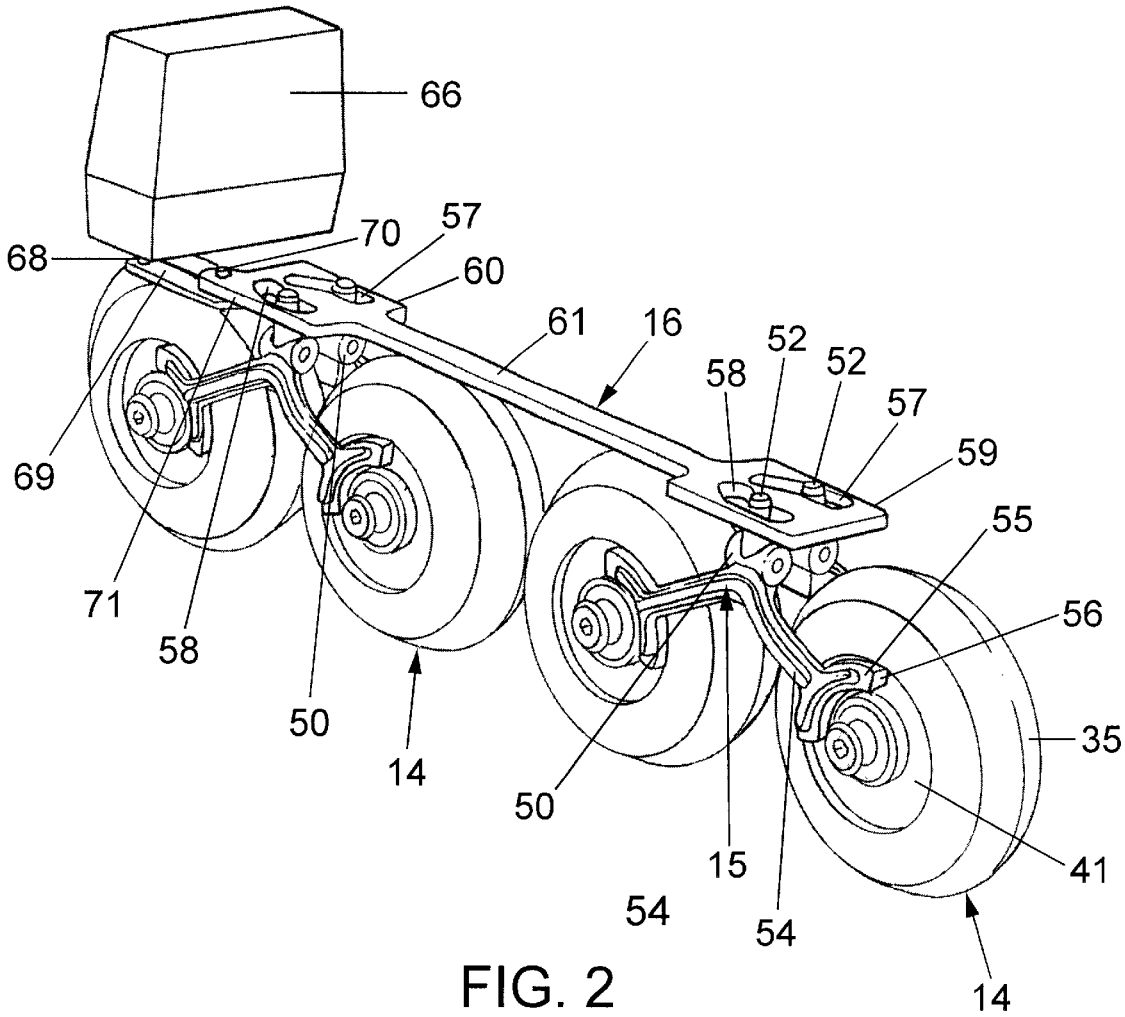
FIG. 2 is an isometric view of the skate brake system of the present invention with the skate boot and wheel support frame deleted.
Figure 3:
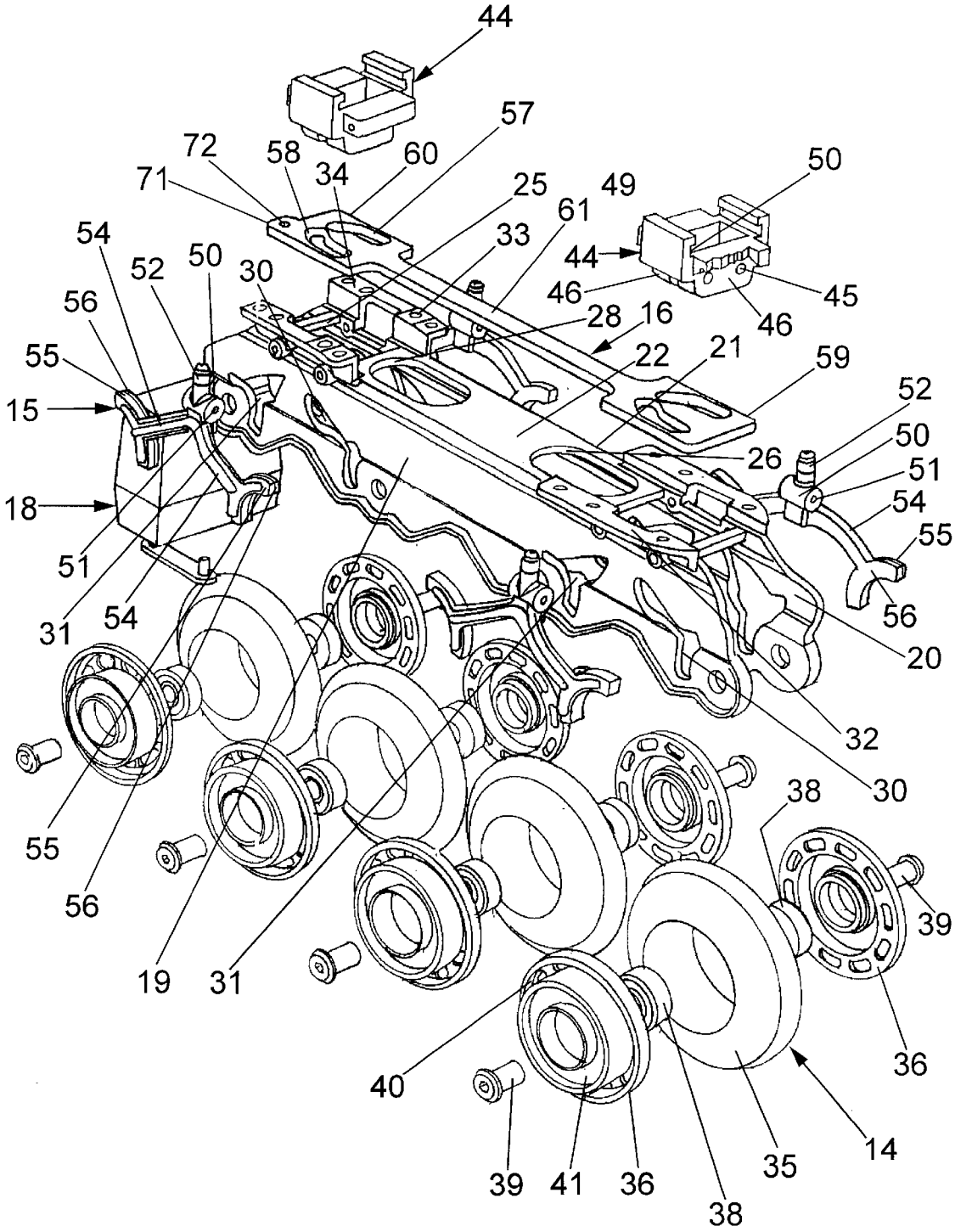
FIG. 3 is an isometric, exploded view of the skate brake system in accordance with the present invention.
Figure 4:
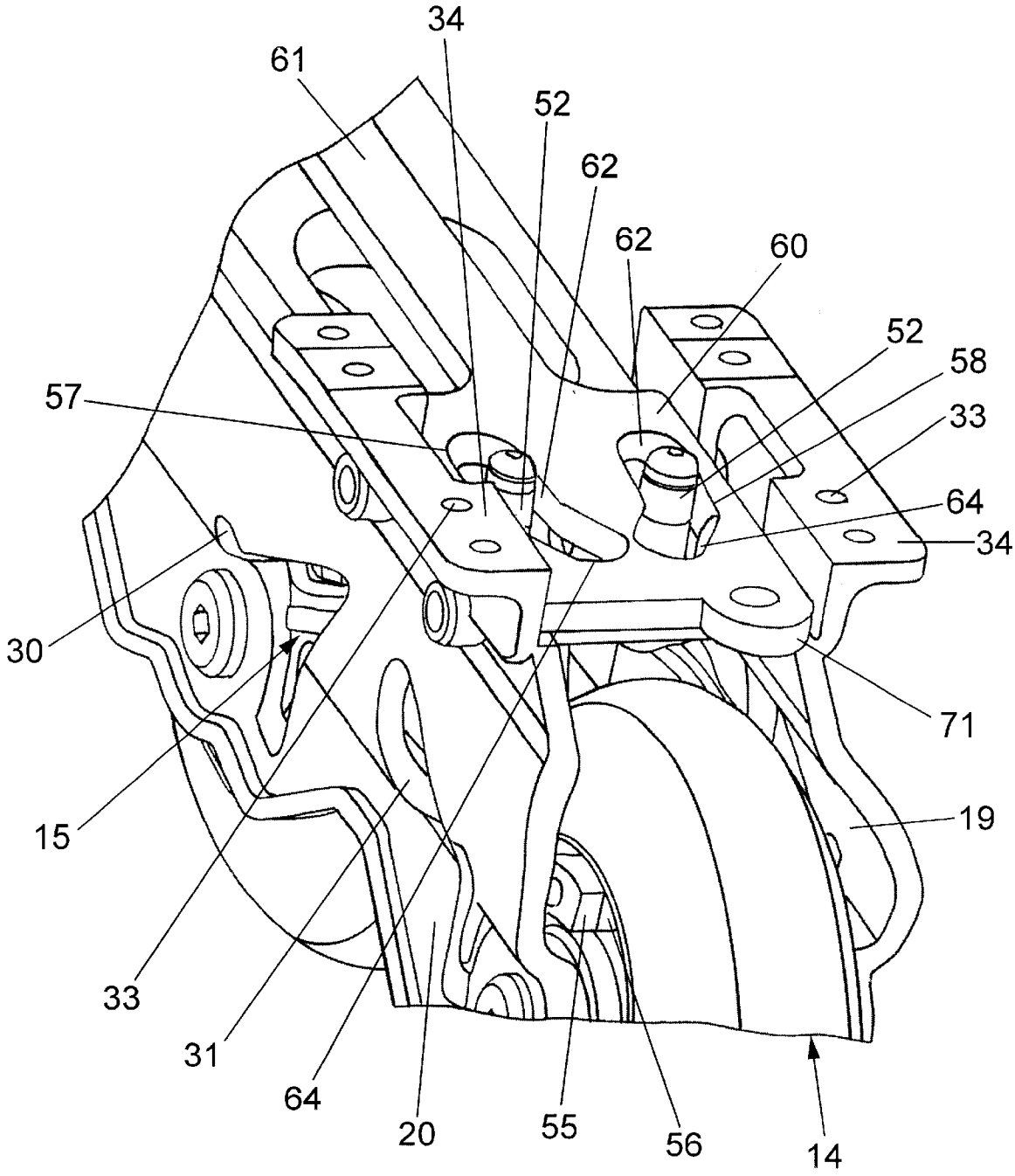
FIG. 4 is an enlarged isometric view of the rearward end of the skate brake system of the present invention.
Figure 5:
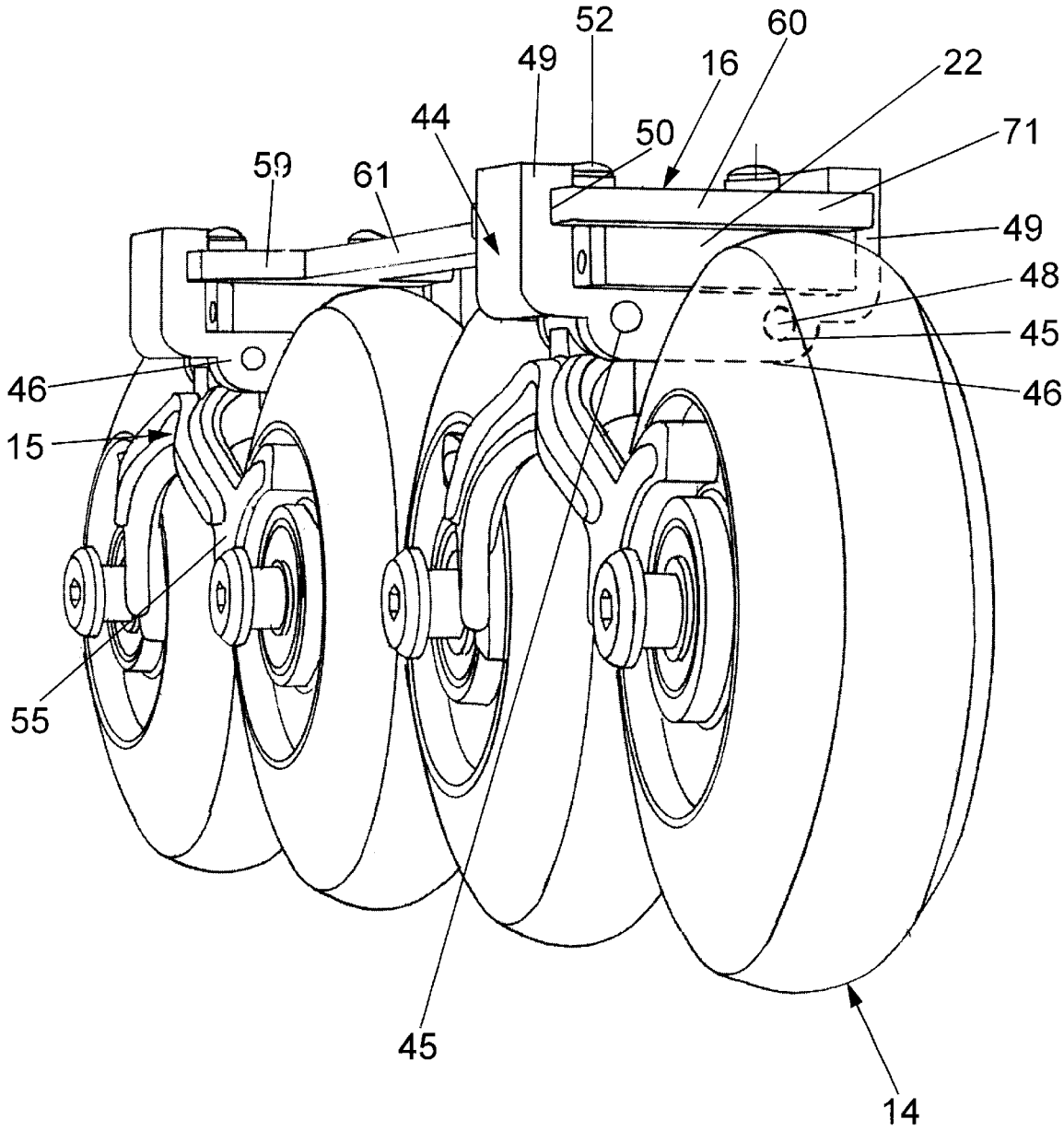
FIG. 5 is a further isometric view of the skate brake system of the present invention with the wheel support frame removed.

Reference is made to FIG. 1 showing an assembled skated with a brake assembly and boot, FIG. 3 showing an exploded view of the wheel support and brake assembly and FIGS. 2, 4 and 5 showing various isometric views of the brake assembly. Specifically, the skate of the present invention includes a boot portion 10 and a wheel support and brake assembly 11. The wheel support and brake assembly 11 may be connected with the bottom of the boot 10 by any means known in the art such via a plurality of threaded members or other clamp means. As shown best in FIG. 3, the wheel support and brake assembly includes a wheel support frame assembly 12, a plurality of wheel assemblies 14, a plurality of brake calipers 15 and an actuator bar 16. The brake assembly also includes an actuator assembly 18 including a remote control signal receiver and a force generating element.

With continuing reference to FIGS. 1–5, the wheel support and frame assembly 12 includes a pair of frame side members or skirts 19 and 20 and a bridging frame portion 21. The bridging frame portion 21 lies in a plane generally parallel to the bottom sole of the skate boot 10 and includes a pair of side edges integrally joined with the top edges of the frame side portions 19 and 20. The bridging frame portion 21 includes a generally planar member 22 which functions as a support and guide surface for the actuator bar 16 as will be described in greater detail below. A forward brake access opening 24 and a rearward brake access opening 25 are provided in the bridging frame portion 21 to provide access between the actuator bar 16 and the brake assemblies 15. Secondary openings 26 and 28 are provided to reduce overall weight of the brake system and to facilitate access to the bottom of the boot 10, if needed.

The frame side portions 19 and 20 are integrally joined with the bridging frame portion 21 and extend downwardly therefrom in generally laterally spaced relationship to one another. Each of the portions 19 and 20 include a plurality of wheel support openings 29 positioned along the length of the portions 19 and 20 near their lower edges. The corresponding openings 29 in the frame sides 19 and 20 are linearly aligned with one another. In the preferred embodiment, each of the frame portions 19 and 20 include four corresponding wheel support openings 29.

Each of the frame side portions 19 and 20 also include two pairs of caliper access openings, with each pair comprising a forward caliper access opening 30 and a rearward caliper access opening 31. As will be described in greater detail below, the openings 30 and 31 allow the caliper arms to extend through the openings for braking engagement with the wheel assemblies.

Extending upwardly from the surface portion 22 of the bridging portion 21 are a plurality of connection bracket members functioning primarily to guide movement of the actuator bar 16 in generally linear and reciprocal movement. The connection members include a pair of laterally spaced forward connection bracket members 32,32 and a pair of rearward connection bracket members 34,34. Each of the bracket members 32,32 and 34,34 is provided with opening 33 for connecting the frame 12 to the boot 10 (FIG. 1).

Each of the wheel assemblies 14 includes a central ground engaging wheel or wheel portion 35, a pair of central hubs 36,36, a pair of bearings 38,38 and a pair of axle portions 39,39. In the preferred embodiment, each of the hubs 36 includes an outer flange portion 40, a central opening 42 and an outwardly facing surface portion 41 forming a first braking surface. When assembled, the flange portion 40 is positioned inwardly and adjacent to the center wheel 35, with the braking surface 41 facing outwardly and in a plane generally perpendicular to the rotational axis of the wheel assemblies 14. Such rotational axis is defined by the axle members 39,39. Each of the bearings 38,38 is press fit within the center opening 42 of a respective hub 36,36. The wheel assemblies 14 can be conventional inline skate wheel assemblies except for the provision of the first braking surface 41. In the preferred embodiment, the hubs 36,36 are constructed of aluminum or other light weight and strong material and the center wheel 35 is constructed of a plastic material such as urethane. In the preferred construction, the plastic wheel member 35 is molded over the hubs 36,36.

As shown best in FIGS. 5–8, the wheel support frame is provided with means for pivotally supporting the plurality of calipers 15. One embodiment of this means is shown in FIG. 5 by a plurality of pivot support members 44. Each pivot support member 44 is rigidly connected with the wheel support frame 12. Each side of the bracket 44 includes a pair of support ears 46,46 which are spaced in the longitudinal direction of the skate. Each of the ears 46 is provided with a pivot opening 45. The openings 45 are designed to receive a pivot pin 48 for pivotally supporting the calipers 15 as will be described in greater detail below. The bracket 44 also includes an actuator bar retaining portion 49 extending upwardly past the bridging frame portion 22. The upper end of each portion 49 includes a retaining groove or recess 50. The recess 50 receives an outer edge of the actuator bar 16 as shown in FIG. 5 for the purpose of guiding the reciprocal movement of the bar and limiting its vertical movement relative to the frame portion 22.

As shown, each bracket 44 includes a pair of laterally spaced retaining members 49, with each side of the bracket 44 further including a pair of spaced pivot support ears 46,46. In the preferred embodiment, the brake assembly includes two such brackets 44, one for pivotally supporting the pair of calipers 15 at the forward end of the skate and the other for pivotally supporting the pair of calipers at the rearward end of the skate. The brackets 44 are rigidly connected with the wheel support frame assembly 12. Thus, they can be integrally formed with the frame 12 or separately formed and connected to the frame such as via a plurality of threaded members or by welding or the like. Although Figure A shows the brackets 44 at both the forward and rearward ends of the skate as including an actuator bar retaining portion 49 with retaining groove 50, such groove 50 and corresponding retaining portion 49 may be eliminated, if desired, at the forward end of the skate, with the actuator bar 16 being retained by engagement with the bottom surface of the boot 10.

Figure 6:
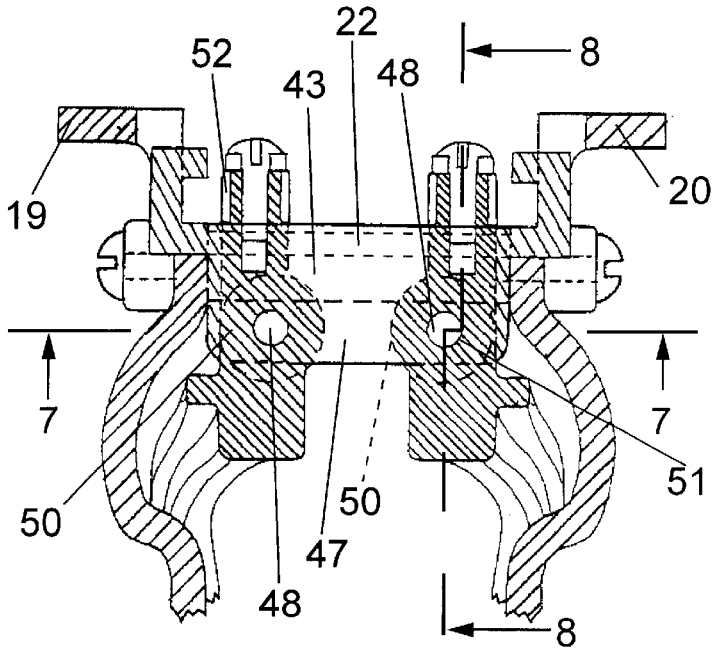
FIG. 6 is a view, partially in section, of the structure for pivotally supporting the callipers of the brake system.
Figure 7:
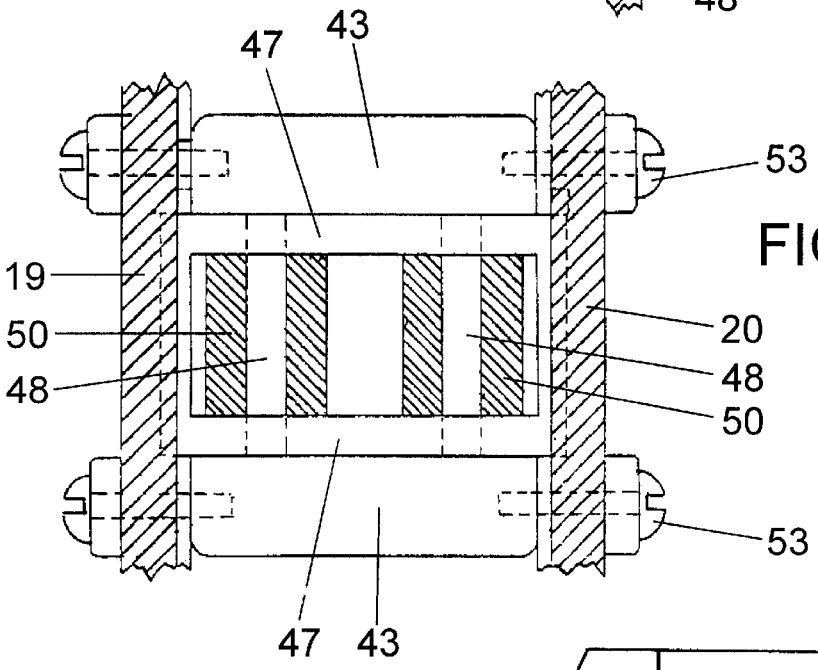
FIG. 7 is a view, partially in section, as viewed along a section line 7—7 of FIG. 6.
Figure 8:
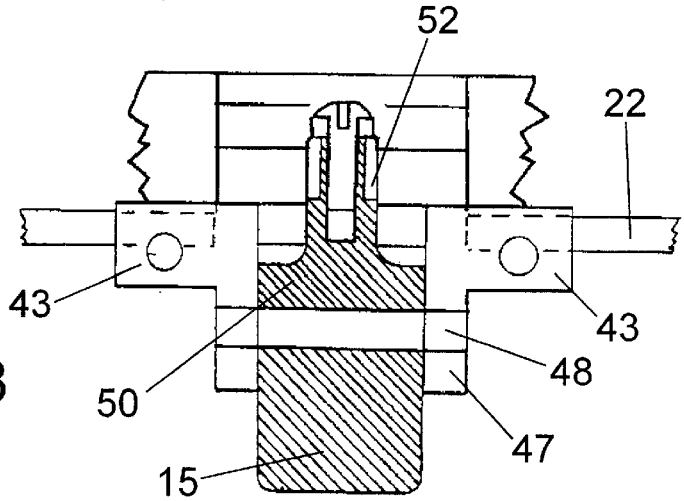
FIG. 8 is a view, partially in section, as viewed along the section line 8—8 of FIG. 6.

A further embodiment of the means for pivotally supporting the plurality of callipers 15 is shown in FIGS. 6, 7 and 8. In these figures, a pair of longitudinally spaced brackets 43 are secured to the wheel support frame 12 by a plurality of threaded members 53 extending through the frame sides 19 and 20 into the brackets 43. Each of the brackets 43 includes a downwardly extending flange 47 having a pair of laterally spaced openings to support the calliper pivot pin 48. The pivot portions 50 of the callipers are pivotally supported on the pins 48 between the flanges 47.

The brake assembly of the present invention is preferably provided with four caliper assemblies 15. These comprise two caliper assemblies (a forward assembly and a rearward assembly) on each side of the skate. As shown best in FIG. 3, each caliper assembly includes a pivot portion 50 having a pivot opening 51 extending therethrough. Preferably, the pivot opening 51 extends in the longitudinal direction of the skate so that the pivot member and thus the entire caliper is pivotable about an axis generally parallel to the longitudinal axis of the skate. A caliper follower or actuator pin 52 extends upwardly from the pivot portion 50 for engagement with cam slots 58 in the actuator bar 60 as described below. The pin 52 extends vertically upwardly from the pivot portion 50 and preferably includes a brass sleeve 53 or other durable, low friction portion for engaging the cam slots 58.

Each of the calliper assemblies 15 are twin callipers which include a pair of caliper arms 54,54 extending generally downwardly from the pivot member 50 in a diverging configuration as shown. The distal end of each of the caliper arms 54,54 is provided with a brake surface support portion 55. As shown, each portion 55 is generally arcuately shaped to conform to the curvature of the brake surface 41 on the wheel hub 36. Each brake surface support member 55 includes an inwardly facing brake surface or a surface to which a brake surface element 56 is connected. In the preferred embodiment, a separate brake surface element 56 is connected with each brake surface support member 55 for making braking engagement with the brake surface portion 41 of the wheel assembly 14.

As discussed above, and as shown best in FIGS. 6, 7 and 8, each calliper assembly is pivotally connected relative to the wheel support frame 12 via the pivot pins 48 extending through the pivot openings 51. The arms 54,54 of each calliper extend outwardly through respective openings 30 and 31 provided in the frame sides 19 and 20 for each calliper assembly 15. The brake surface support portions 55 or the brake surface element 56 connected thereto are then free to selectively engage the braking surface 41. It is contemplated that the brake surface element 56 can be any one of a variety of materials that provides desired braking friction when engaged with the brake surface 41. Such material can range from relatively hard metals commonly used as braking surfaces to softer rubber or synthetic materials.

The actuator bar 16 is an elongated member having a forward actuator section 59, a rearward actuator section 60 and a central connecting portion 61 which connects the forward and rearward actuator sections 59 and 60. Each of the sections 59 and 60 includes a pair of actuator cam slots 57 and 58 for moving the caliper follower pins 52 and thus pivoting the caliper assemblies 15. Each of the cam slots 57 and 58 includes a braking portion 62 and a release portion 64. As shown best in FIG. 4, the portions 62 diverge slightly from one another as they extend towards the forward end of the skate, while the portions 64 converge more significantly toward one another as they extend toward the rearward end of the skate. In the preferred embodiment, the entire inner edge of the cam slots 57 and 58 is provided with a cam or bearing surface. The actuator bar 16 is positioned to allow the cam pins 52 to extend upwardly through a respective cam slot 57 and 58. Thus, as the actuator bar and the actuator sections 59 and 60 are moved forwardly and rearwardly relative to the wheel support frame 12, the cam surfaces of the slots 57 and 58 cause lateral inward and outward cause lateral pivotal movement of the pins 52 about the pivot pin 48. This inward and outward movement of the pins results in the pivoting of the entire calliper assemblies 15. This in turn results in corresponding pivotal movement of the caliper arms 54 and thus movement of the brake surface support elements 55 between a braking position in which the brake surface element 56 is engaged with the brake surface 41 and a non-braking position in which the brake surface of the element 56 and the brake surface 41 are disengaged from one another.

Specifically, as the actuator bar 16 is moved forwardly relative to the wheel support frame 12,the brake release portions 64 of the cam slots 57 and 58 pivot the pins 52 inwardly toward one another, thereby causing the brake surface support elements 55 to pivot outwardly from one another to a non-braking position. Conversely, when the actuator bar 16 is moved rearwardly relative to the wheel support frame 12, the brake engaging portions 62 of the cam slots 57 and 58 cause the pins 52 to pivot away from one another, thereby causing the brake surface support members 55 to pivot toward one another and thus into braking engagement with the brake surface 41 of the wheels. Accordingly, by moving the actuator bar 16 forwardly and rearwardly relative to the wheel support frame 12, the caliper assemblies 15 can be moved between non-braking and braking positions respectively.

As shown, the brake the brake surface support members 55 of each caliper assembly are designed to engage a separate wheel. Thus the forward caliper assemblies at the forward end of the brake engage the brake surfaces 41 on opposite sides of each of the two forward wheels 14, while the brake surface support members 55 of the rearward caliper assemblies 15 engage the brake surfaces 41 on opposite sides of the two rearward wheels 14.

Figure 9:
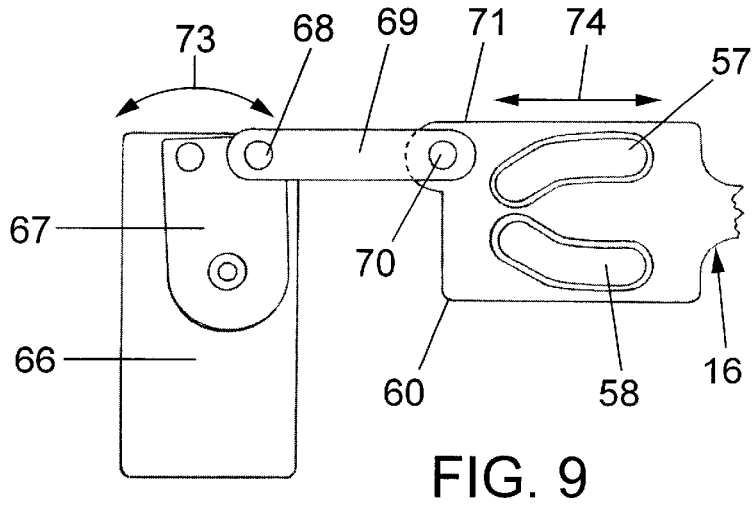
FIG. 9 is an elevational bottom view of the actuation means showing the connection between the actuator solenoid and the actuator bar.

The brake assembly in accordance with the present invention also includes means for actuating the actuator bar 16 or for moving the actuator bar 16 forwardly and rearwardly as described above to move the caliper assemblies 15 between braking and non-braking positions. In the preferred embodiment, this means includes a solenoid 66 or other motion generating or force exerting device. More specifically, as shown in FIG. 9, the means for moving the actuator bar 16 and thus the calipers 15 between a brake and non-brake position includes a rotation member 67 connected to the solenoid 66 for rotational movement in the direction of the directional arrow 72. The rotation member 67 includes one or more motion transfer openings and a corresponding pin 68 connected with an actuator link 69. The link 69 in turn is connected via a motion transfer pin 70 to the actuation bar 16 via the pin 70 extending through a hole 72 in a rearward connecting tab 71 of the actuation section 60. As can be seen, as the solenoid 66 rotates the member 67 in the direction of the arrow 73, the actuator bar 16 moves in the direction of the arrow 74 to move the caliper assemblies 15 between their respective brake and non-brake positions.

The solenoid 66 or other means for moving the actuator bar 16 can be controlled by any appropriate device such as, but not limited to, an actuator cord or cable tethered from the user or by a remote control transmitter such as that shown in U.S. Pat. No. 5,803,468. Preferably, the brake assembly of the present invention is designed for a remote control use. This would require the solenoid assembly 66 to include a receiver for receiving a signal from a remote control transmitter and a means for converting the received signal to a signal for actuating the solenoid 66. In the present embodiment, the solenoid is an HS-815BB Hitec electronic sero.

Figure 10:
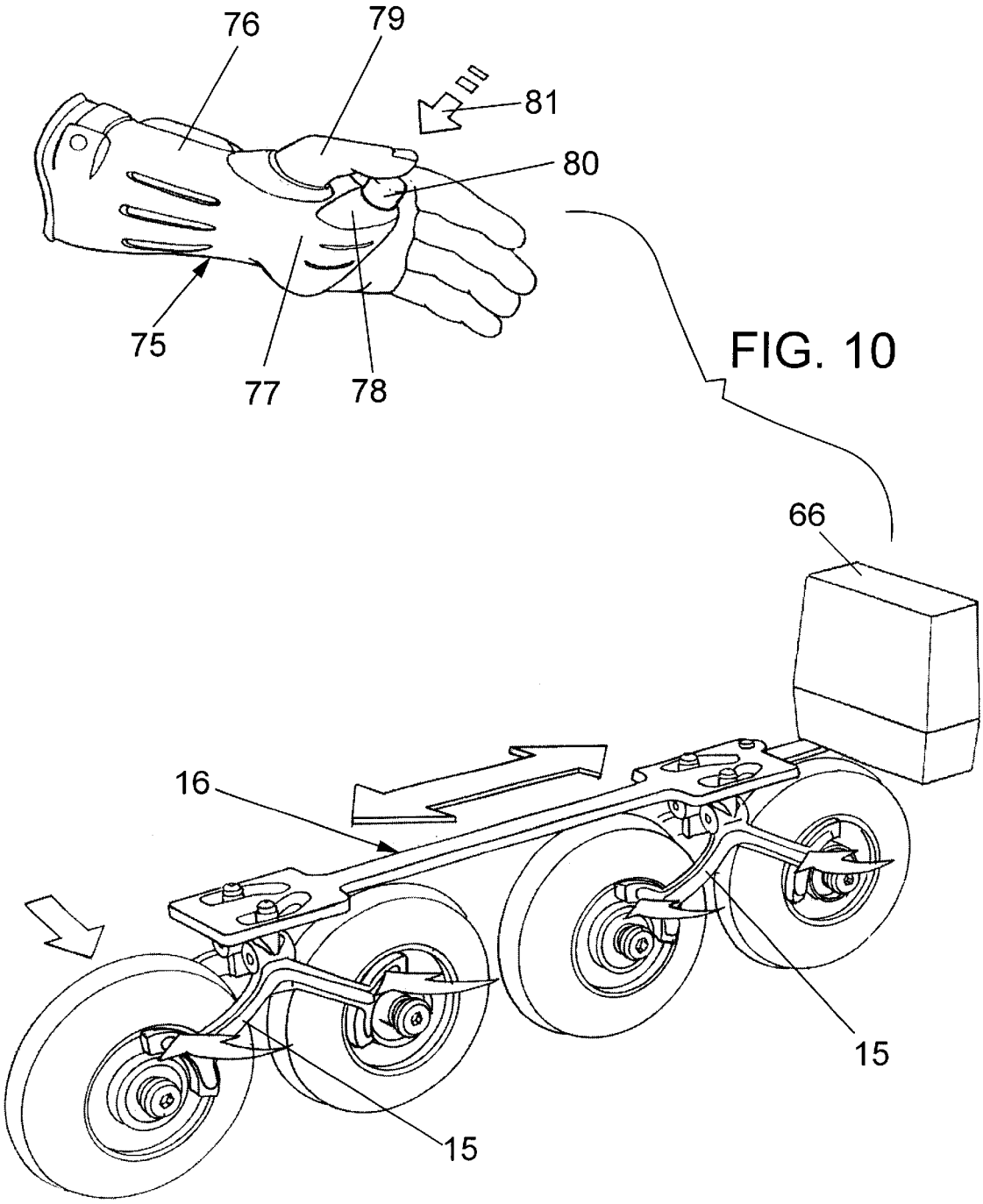
FIG. 10 is an isometric view of a portion of the skate brake system and a remote control actuation glove.

FIG. 10 shows the brake system in combination with a remote control device for remotely controlling the brake system. Specifically, the remote control device preferably includes a glove 75 or other means that would commonly be carried by the hand or arm of the user so that the control could be performed by the user's thumb or one or more of the user's fingers. As shown in FIG. 10, the glove 75 includes a wrist or forearm portion 76 which is designed for selective connection with and removal from the wrist or forearm of the user and a palm portion 77 which carries a transmitter 78. The transmitter 78 includes a depressible actuation or control button 80 which may be depressed by the user's thumb 79. When the button 80 is depressed, the transmitter transmits a radio frequency or other signal to the receiver in the solenoid assembly 66 for actuating the brake assembly, specifically, as the button 80 is depressed by the user's thumb in the direction of the arrow 81, a braking signal is transmitted to the receiver in the solenoid 66 which causes movement of the actuator bar 16 to activate the brake system. Release of the button 80 will result in a release of the braking force. Preferably, the transmitter and receiver are designed so that the more the button 80 is depressed, the greater the braking force.

Accordingly, it can be seen that the inline skate and brake system of the present invention includes a wheel support frame 12 and a plurality of wheels or wheel assemblies 14 linearly spaced from one another and rotatably supported by the frame. Each of the wheel assemblies includes a brake surface 41 positioned on the hubs on each side of the wheel assemblies. The brake system also includes a plurality of brake elements associated with the wheels and carried by the frame 12. Each of these brake elements or calipers 15 includes a second brake surface, with each of those surfaces being moveable relative to the frame between a brake position in which the brake surfaces of the wheel assemblies and the caliper assemblies are engaged and a non-brake position in which the brake surfaces of the wheel assemblies and the brake surfaces of the caliper assemblies are disengaged. The system also includes an actuator member operatively connected with the caliper assemblies 15 to move its respective brake elements between such brake and non-brake positions.

Although the description of the preferred embodiment has been quite specific, it is contemplated that various modifications could be made without deviating from the spirit of the invention. Accordingly, it is intended that the scope of the present invention be dictated by the appended claims rather than by the description of the preferred embodiment.

What is claimed is:

1. A brake system for a wheeled article comprising:

a frame;

a plurality of wheels linearly spaced from one another and rotatably supported by said frame, at least one of said wheels including a first brake surface;

a brake element associated with said at least one wheel, said brake element carried by said frame, having a second brake surface and being moveable relative to said frame between a brake position in which the first brake surface of said at least one wheel and the second brake surface of its associated brake element are engaged and a non-brake position in which the first brake surface of said at least one wheel and the second brake surface of its associated brake element are disengaged; and an actuator member operatively connected with said brake element to move said brake element between said brake and non-brake positions, said brake element including a cam follower surface and said actuator member including a cam slot having a cam surface.

2. The system of claim 1 including the brake element associated with a plurality of said wheels.

3. The system of claim 2 wherein said actuator member is operatively connected with each of said brake elements.

4. The system of claim 2 including a brake element associated with each of said wheels.

5. The system of claim 4 wherein said actuator member is operatively connected with each of said brake elements.

6. The system of claim 1 wherein said brake element is pivotally connected with said frame and pivotally moveable between said brake and non-brake positions.

7. The system of claim 6 including a longitudinal axis extending generally in the direction of said plurality of wheels and wherein said actuator member is moveable reciprocally in a direction parallel to said longitudinal axis to pivot said brake element between said brake and non-brake positions.

8. The system of claim 1 including a first brake surface on each side of said wheel and a pair of brake elements each having a second brake surface, each of said brake element being moveable between a brake position in which said first brake surface on one side of said wheel is engaged with said second brake surface of one of said pairs of brake elements and said first brake surface on the other side of said wheel is engaged with said second brake surface on the other of said pair of brake elements.

9. The system of claim 8 including a pair of wheels each having a first brake surface on each side and wherein one of said pair of brake elements includes a pair of second brake surfaces for braking engagement with the first brake surface and one side of each of said pair of wheels.

10. The system of claim 1 including an actuator operatively connected to said actuator member to move said actuator member between brake and non-brake positions.

11. The system of claim 10 wherein said actuator is electrically powered and is remotely controlled.

12. The system of claim 1 wherein said at least one wheel includes a central hub and a peripheral ground engaging portion and said hub includes said first brake surface.

13. The system of claim 1 including a skate boot connected to said frame.

14. The system of claim 1 wherein said wheeled article is an inline skate.

15. A brake system for a wheeled article comprising:

a frame;

a plurality of wheels linearly spaced from one another and rotatably supported by said frame, at least one of said wheels including a first brake surface;

a brake element associated with said at least one wheel, said brake element carried by said frame, having a second brake surface and being moveable relative to said frame between a brake position in which the first brake surface of said at least one wheel and the second brake surface of its associated brake element are engaged and a non-brake position in which the first brake surface of said at least one wheel and the second brake surface of its associated brake element are disengaged, wherein said brake element is pivotally connected with said frame and pivotally moveable between said brake and non-brake positions; and an actuator member operatively connected with said brake element to move said brake element between said brake and non-brake positions and wherein one of said actuator member and said brake element includes a cam surface and the other of said actuator member and said brake element includes a cam follower surface and wherein said actuator member and said brake elements are operatively connected by said cam surface and said cam follower surface; and a longitudinal axis extending generally in the direction of said plurality of wheels and wherein said actuator member includes a cam surface and is moveable reciprocally in a direction parallel to said longitudinal axis to pivot said brake element between said brake and non-brake positions, wherein said brake element includes a cam follower surface and wherein said cam surface is provided on a cam slot in said actuator element.

16. A brake assembly for a skate having a skate boot and a plurality of wheels each having a first brake surface and a wheel support frame rotatably supporting said wheels and connected with said skate boot, said assembly comprising:

a pair of opposing brake elements pivotally connected to the skate frame, each of said brake elements including a second brake surface and a first cam surface, said second brake surface of one of said pair of brake elements adapted for selective braking engagement with said first brake surface on one side of said wheel and said second brake surface of the other of said brake elements adapted for selective braking engagement with said first brake surface on the other side of said wheel and a brake actuator having a second cam surface, at least one of said first and second cam surfaces being defined by a cam slot.

17. The assembly of claim 16 including a pair of linearly aligned wheels, each having a first brake surface on each side thereof and wherein each of said pair of brake elements includes a pair of second brake surfaces, said pair of second brake surfaces of one of said brake elements adapted for selective braking engagement with said first brake surfaces on one side of said pair of wheels and said pair of second brake surfaces of the other of said brake elements adapted for selective braking engagement with said first brake surfaces on the other side of said pair of wheels.

18. The assembly of claim 17 wherein each of said wheels includes a central hub and a peripheral ground engaging portion and wherein said hub includes said first brake surfaces.

19. The assembly of claim 16 wherein said brake actuator is remotely controlled.

20. The assembly of claim 19 in combination with a user control wherein said user control includes a transmitter and said brake actuator includes a receiver to receive a control signal from said transmitter.

21. The assembly of claim 16 wherein said brake actuator is operatively connected with said brake elements, said brake actuator moveable to a brake position to cause movement of said brake elements to a brake position in which said second brake surfaces are engaged with their respective first brake surfaces.

* * * * *